US009096365B2

(12) United States Patent
Kim

(10) Patent No.: US 9,096,365 B2
(45) Date of Patent: Aug. 4, 2015

(54) VACUUM GENERATING APPARATUS AND VACUUM CONTAINER PROVIDED WITH THE SAME

(76) Inventor: Yong-Kug Kim, Anyang-si (KR)

( * ) Notice: Subject to any disclaimer, the term of this patent is extended or adjusted under 35 U.S.C. 154(b) by 400 days.

(21) Appl. No.: 13/521,468

(22) PCT Filed: Aug. 5, 2010

(86) PCT No.: PCT/KR2010/005139
§ 371 (c)(1),
(2), (4) Date: Jul. 11, 2012

(87) PCT Pub. No.: WO2011/087196
PCT Pub. Date: Jul. 21, 2011

(65) Prior Publication Data

US 2013/0146500 A1 Jun. 13, 2013

(30) Foreign Application Priority Data

Jan. 15, 2010 (KR) ..... 10-2010-0004043

(51) Int. Cl.
*B65D 81/20* (2006.01)

(52) U.S. Cl.
CPC ..... *B65D 81/2038* (2013.01)

(58) Field of Classification Search
CPC ..... B65B 31/047; B65D 81/2038; F16J 13/24
USPC ..... 141/65, 8; 215/260, 311; 220/202, 220/203.01, 231
See application file for complete search history.

(56) References Cited

U.S. PATENT DOCUMENTS

| | | | | |
|---|---|---|---|---|
| 4,823,968 | A * | 4/1989 | Handzlik | 215/228 |
| 5,390,809 | A * | 2/1995 | Lin | 220/212 |
| 5,564,480 | A * | 10/1996 | Chen | 141/65 |
| 5,651,470 | A * | 7/1997 | Wu | 220/212 |
| 5,653,352 | A * | 8/1997 | Kim | 215/228 |
| 5,992,666 | A * | 11/1999 | Wu | 220/212 |
| 6,044,756 | A * | 4/2000 | Chang | 99/472 |
| 6,375,024 | B1 * | 4/2002 | Park | 215/262 |
| 6,644,489 | B2 * | 11/2003 | Chang | 220/203.01 |
| 6,994,227 | B2 * | 2/2006 | Kwon | 220/212 |

FOREIGN PATENT DOCUMENTS

| | | |
|---|---|---|
| EP | 1714910 | 10/2006 |
| EP | 1961672 | 8/2008 |

(Continued)

*Primary Examiner* — Jason K Niesz
*Assistant Examiner* — Andrew StClair
(74) *Attorney, Agent, or Firm* — Lexyoume IP Meister, PLLC

(57) ABSTRACT

The present invention relates to a vacuum container. The vacuum container includes a piston member linearly movably disposed in a receiving portion which is formed at the vacuum container and has a first outlet and provided with a second outlet, an elastic member disposed in the piston member, a first valve plate disposed in the receiving portion and adapted to open or close the first outlet, a second valve plate disposed at the piston member and adapted to open or close the second outlet, a separation preventing plate mounted in the receiving portion and preventing separation of the piston member, and a unit for pressuring the first valve plate which is mounted in the receiving portion and is adapted to close the first outlet by pressurizing the first valve plate if the piston member descends and is caught by and fixed to the separation preventing plate. Thereby, vacuum state can be continuously maintained in the vacuum container.

13 Claims, 10 Drawing Sheets

(56) References Cited

FOREIGN PATENT DOCUMENTS

| | | | | |
|---|---|---|---|---|
| GB | 2316452 A * | 2/1998 | ..... | B65B 31/04 |
| JP | 2620147 | 3/1997 | | |
| KR | 100429069 | 4/2004 | | |

* cited by examiner

FIG. 2
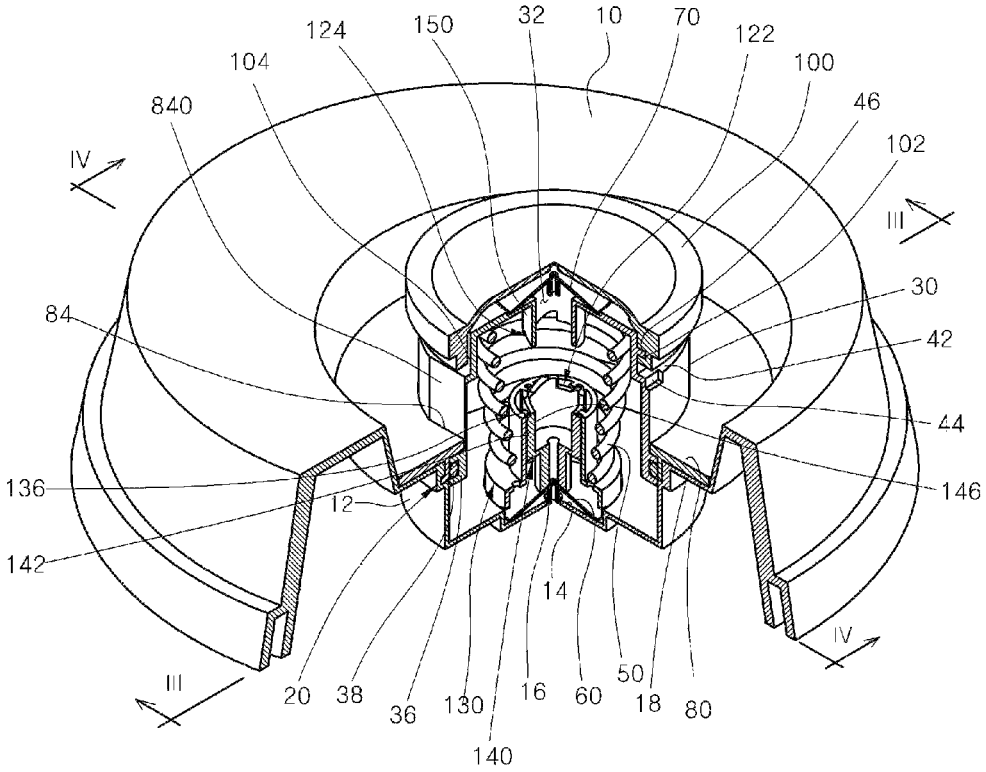
【FIG. 3】
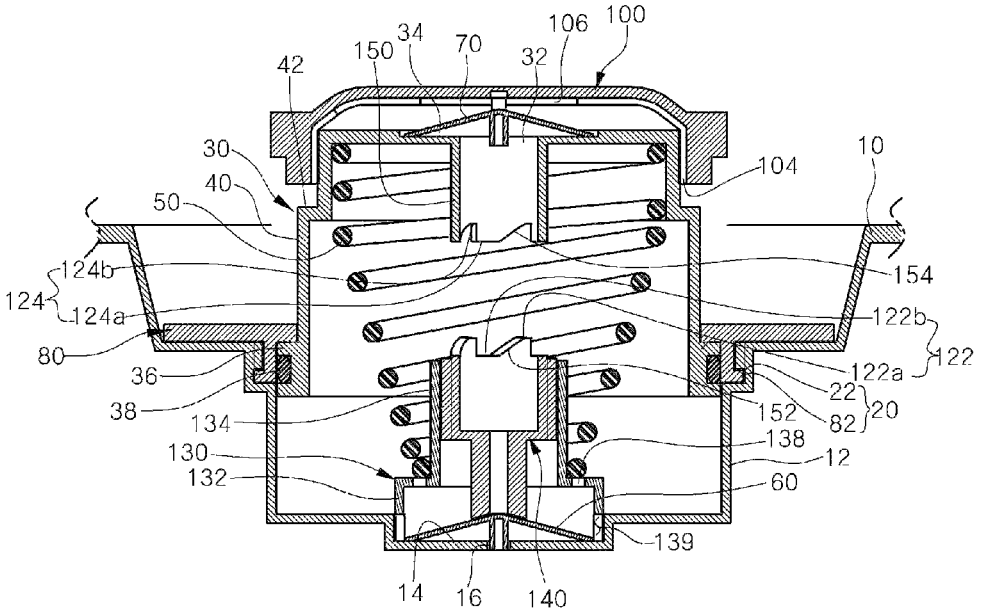

VACUUM GENERATING APPARATUS AND VACUUM CONTAINER PROVIDED WITH THE SAME

TECHNICAL FIELD

The present invention relates to a vacuum generating apparatus generating vacuum and a vacuum container provided with the vacuum generating apparatus.

BACKGROUND

Generally, foodstuffs such as vegetables and fishes are easily oxidized and rotten by contacting with harmful substances such as microorganisms or oxygen contained in air when the foodstuffs contact with the air.

In addition, microorganisms are reproduced more actively in fermented foods. Therefore, fermentation speed or aging speed of foods is excessively fast such that keeping quality may be deteriorated. Meanwhile, it is very important to block the foods from the outside air so as to delay fermentation and rot of the foods. In order to solve such problems, a sealed container such as a vacuum container is proposed.

As time goes by, the outside air flows and vacuum maintaining force of the currently used vacuum container may be deteriorated. Therefore, foodstuffs or contents that are stored in the vacuum container may be exposed to the air.

DETAILED DESCRIPTION OF THE INVENTION

Technical Object

The present invention has been made in an effort to provide a vacuum generating apparatus and a vacuum container provided with the same having advantages of maintaining vacuum maintaining force in the vacuum container even though a time has passed.

Means for Achieving the Object

A vacuum generating apparatus according to an exemplary embodiment of the present invention may include a piston member linearly movably disposed in a receiving portion which is formed at a vacuum chamber and has a first outlet, and provided with a second outlet, an elastic member disposed inside of the piston member, a first valve plate disposed in the receiving portion and adapted to open or close the first outlet, a second valve plate disposed at the piston member and adapted to open or close the second outlet, a separation preventing plate mounted in the receiving portion and preventing separation of the piston member, and a unit for pressuring the first valve plate which is mounted in the receiving portion and is adapted to close the first outlet by pressurizing the first valve plate if the piston member descends and is caught by and fixed to the separation preventing plate.

The unit for pressuring the first valve plate may include a supporting member disposed on the receiving portion and having a vertically hollow inside, a pressing rod positioned in the supporting member and adapted to press the first valve plate, and an operating rod connected to the piston member and adapted to press the pressing rod if the piston member descends and is caught by and fixed to the separation preventing plate.

The supporting member may include an accepting portion positioned on a bottom surface of the receiving portion and having at least one air exhaust hole at a surface thereof, and a guide portion connected to the accepting portion, having a smaller circumference than the accepting portion, and having at least one guide groove formed at an interior surface thereof, wherein at least one guide protrusion inserting in the guide groove is formed at an exterior circumference of the pressing rod.

A catching groove may be formed at the accepting portion, and a catching protrusion inserted in the catching groove may be formed on the bottom surface of the receiving portion.

The unit for pressuring the first valve plate may further include cam portions formed at confronting surfaces of the pressing rod and the operating rod.

The cam portions may include first protrusions and depressions formed at the pressing rod and second protrusions and depressions formed at the operating rod.

The first protrusions and depressions may include a plurality of first convex portions disposed with even distances, a plurality of first recess portions formed between the first convex portions and first slanted surfaces connecting the first convex portions and the first recess portions. The second protrusions and depressions may include a plurality of second convex portions disposed with even distances, a plurality of second recess portions formed between the second convex portions and second slanted surfaces connecting the second convex portions and the second recess portions The second convex portion may press the first convex portion if the piston member descends and is caught by and fixed to the separation preventing plate.

The piston member may penetrate through an inner hole of the separation preventing plate, and at least one flat surface portion may be formed at a circumference of the piston member, A catching step may be formed at a side of the piston member, and a ring portion may be formed at the other side of the piston member.

A rotation preventing protrusion confronting the flat surface portion in a raised state of the piston member may be formed inside of the separation preventing plate, the ring portion may be caught by the rotation preventing protrusion and the piston member cannot further be raised in the raised state. In addition, the piston member may not be caught by the rotation preventing protrusion and be rotatable if the piston member descends, and the catching step may be caught by the rotation preventing protrusion so as to maintain a descent state of the piston member if the piston member rotates in the descent state.

Each of position aligning protrusions that are inserted in the first outlet and the second outlet and align positions of the first valve plate and the second valve plate may be formed at each one surface of the first valve plate and the second valve plate.

A vacuum container according to an exemplary embodiment of the present invention may include a cover at which the vacuum generating apparatus having at least one of above-mentioned features is mounted and a main body coupled to the cover so as to form a storing space.

A vacuum container according to another exemplary embodiment of the present invention may include a main body having a storing space, a cover which can be coupled with the main body and has a first receiving portion, wherein a first outlet communicating the storing space with the exterior is formed at the first receiving portion, a piston member movably disposed in the first receiving portion and provided with a second outlet formed therein, an elastic member disposed in the piston member, a first valve plate disposed in the first receiving portion and adapted to open or close the first outlet, a second valve plate disposed at the piston member and adapted to open or close the second outlet, a separation preventing plate mounted in the first receiving portion and preventing separation of the piston member, and a unit for pressuring the first valve plate which is mounted in the first receiving portion and is adapted to close the first outlet by pressurizing the first valve plate if the piston member descends and is caught by and fixed to the separation preventing plate.

The unit for pressuring the first valve plate may include a supporting member disposed on the receiving portion and having an inside opened vertically, a pressing rod positioned in the supporting member and adapted to press the first valve plate, an operating rod connected to the piston member and adapted to press the pressing rod if the piston member descends and is caught by and fixed to the separation preventing plate, and a cam portion formed at confronting surfaces of the pressing rod and the operating rod.

The highest cam portion of the operating rod may press the highest cam portion of the pressing rod if the piston member descends and is caught by and fixed to the separation preventing plate.

The vacuum container may further include a vacuum release apparatus mounted at the second receiving portion formed at the cover and releasing the vacuum of the storing space, wherein air existing at the outside of the storing space is supplied into the storing space if the vacuum release apparatus is pushed in a direction toward the storing space.

An air inflow hole may be formed at a bottom surface of the second receiving portion.

The vacuum release apparatus may include a push rod disposed in the second receiving portion and being vertically movable, a sealing member connected to the push rod, positioned at the storing space, and sealing the air inflow hole, and an elastic member mounted at a circumference of the push rod and applying elastic force to the push rod away from the storing space.

A vacuum container according to another exemplary embodiment of the present invention may include a main body having a storing space, a cover which can be coupled to the main body and having first and second receiving portions, wherein a first outlet and a second outlet communicating the storing space to the exterior are formed respectively at the first and second receiving portions, a cover which can be coupled to the main body and having first and second receiving portions, wherein a first outlet and a second outlet communicating the storing space to the exterior are formed respectively at the first and second receiving portions, a vacuum release apparatus provided with a push rod disposed in the second receiving portion and being vertically movable, a sealing member connected to the push rod, positioned at the storing space and sealing the air inflow hole and an elastic member mounted at a circumference of the push rod and applying elastic force to the push rod away from the storing space.

Advantageous Effect

If a vacuum is created in the vacuum container, the unit for pressuring the first valve plate presses the first valve plate such that the first valve plate is closely contacted with the first exhaust hole according to an exemplary embodiment of the present invention. Therefore, deterioration of vacuum performance may be prevented as time passes.

BRIEF DESCRIPTION OF THE DRAWINGS

FIG. 2 is a perspective view showing a partial incision surface in a state that a vacuum generating apparatus shown in FIG. 1 is assembled.

FIG. 3 is a cross-sectional view of a vacuum generating apparatus taken along the line III-III in FIG. 2.

MODE FOR EXECUTING THE INVENTION

Figure 1:
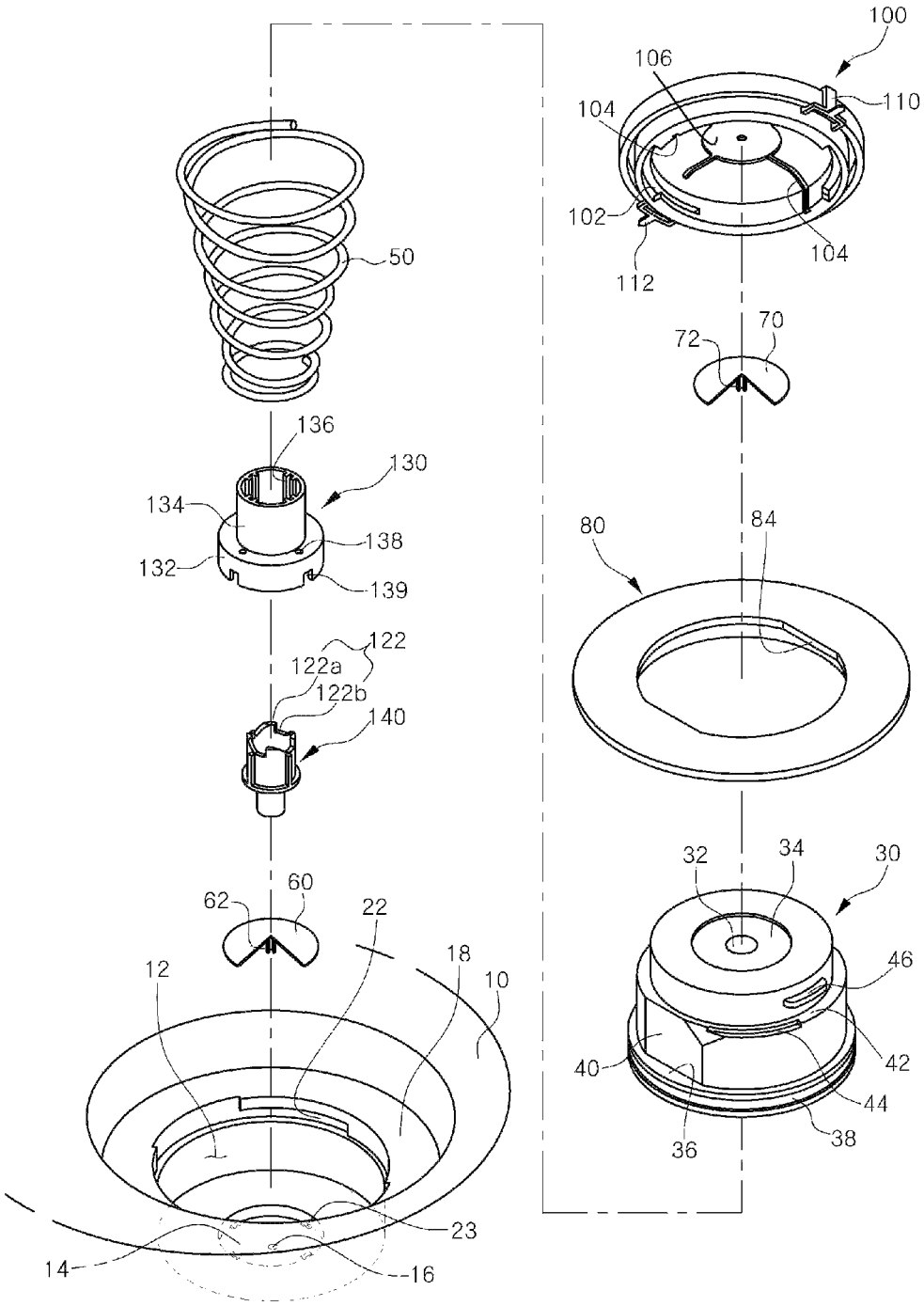
FIG. 1 is an exploded perspective view of a vacuum generating apparatus according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. Like reference numerals designate like elements throughout the specification.

Figure 4:
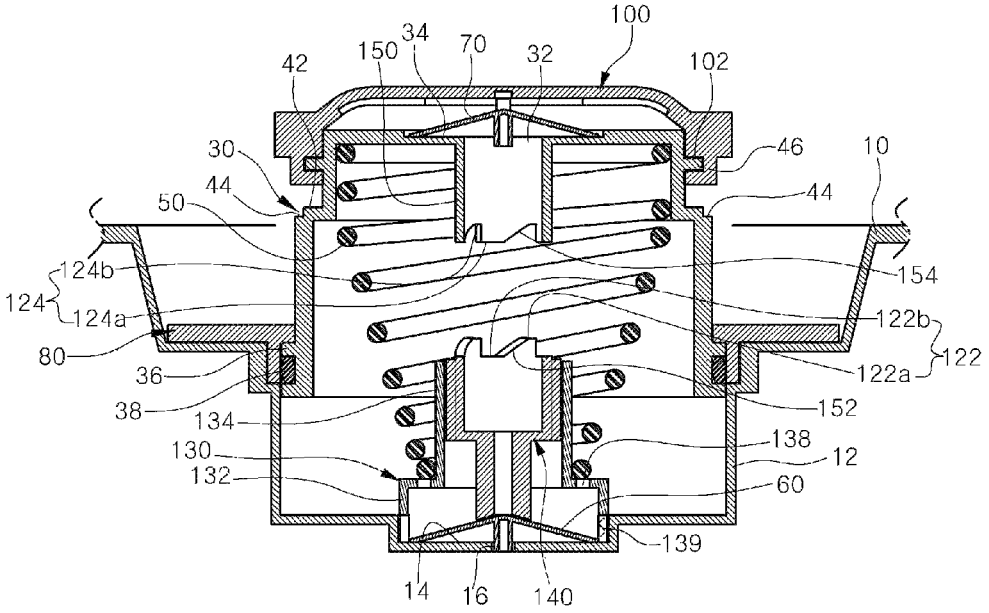
FIG. 4 is a cross-sectional view of a vacuum generating apparatus taken along the line IV-IV in FIG. 2.
Figure 5:
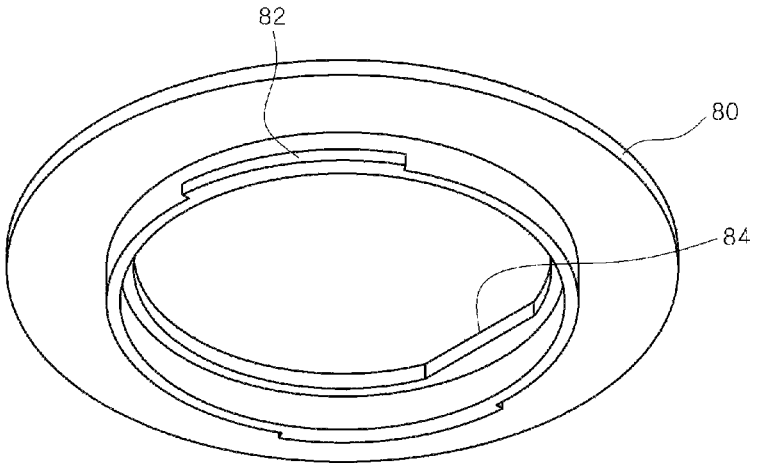
FIG. 5 is a perspective view showing a bottom surface of a separation preventing plate shown in FIG. 1.
Figure 6:
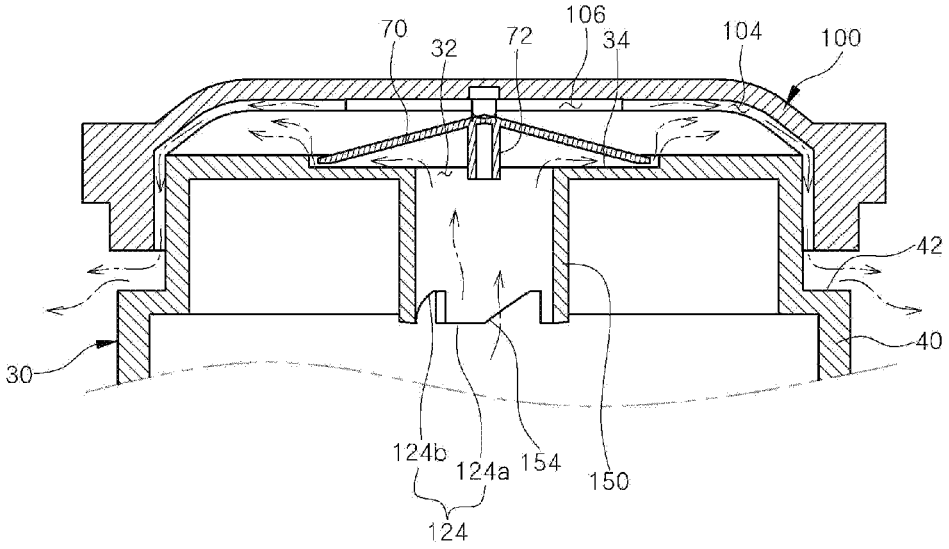
FIG. 6 is a cross-sectional view of a guide groove formed at a cap member in FIG. 1.
Figure 7:
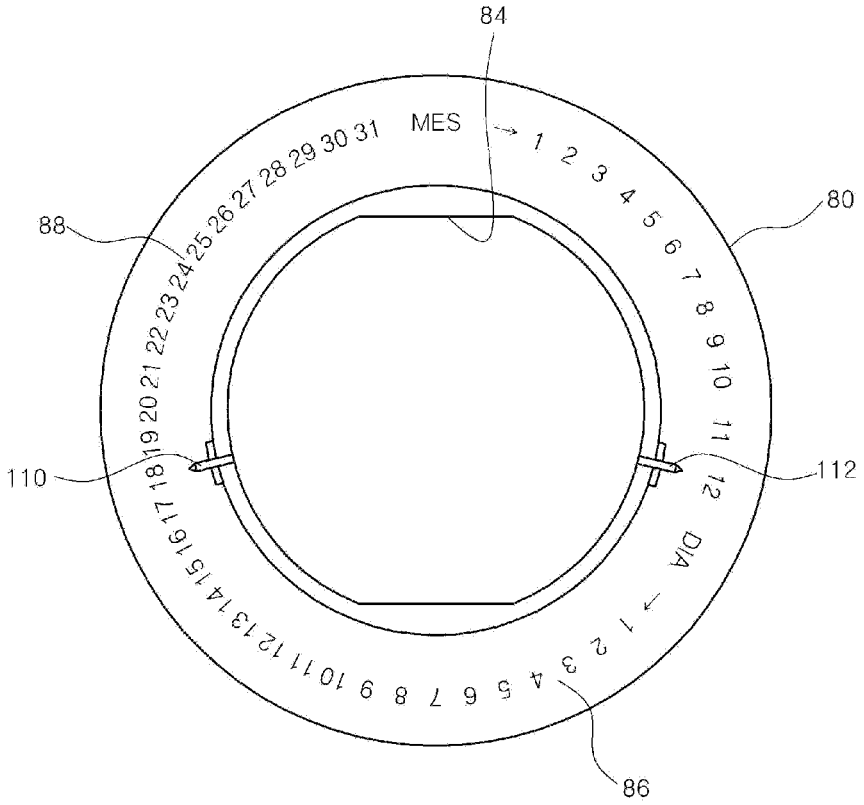
FIG. 7 is a top plan view showing an exemplary variation of a separation preventing plate in FIG. 1.
Figure 8:
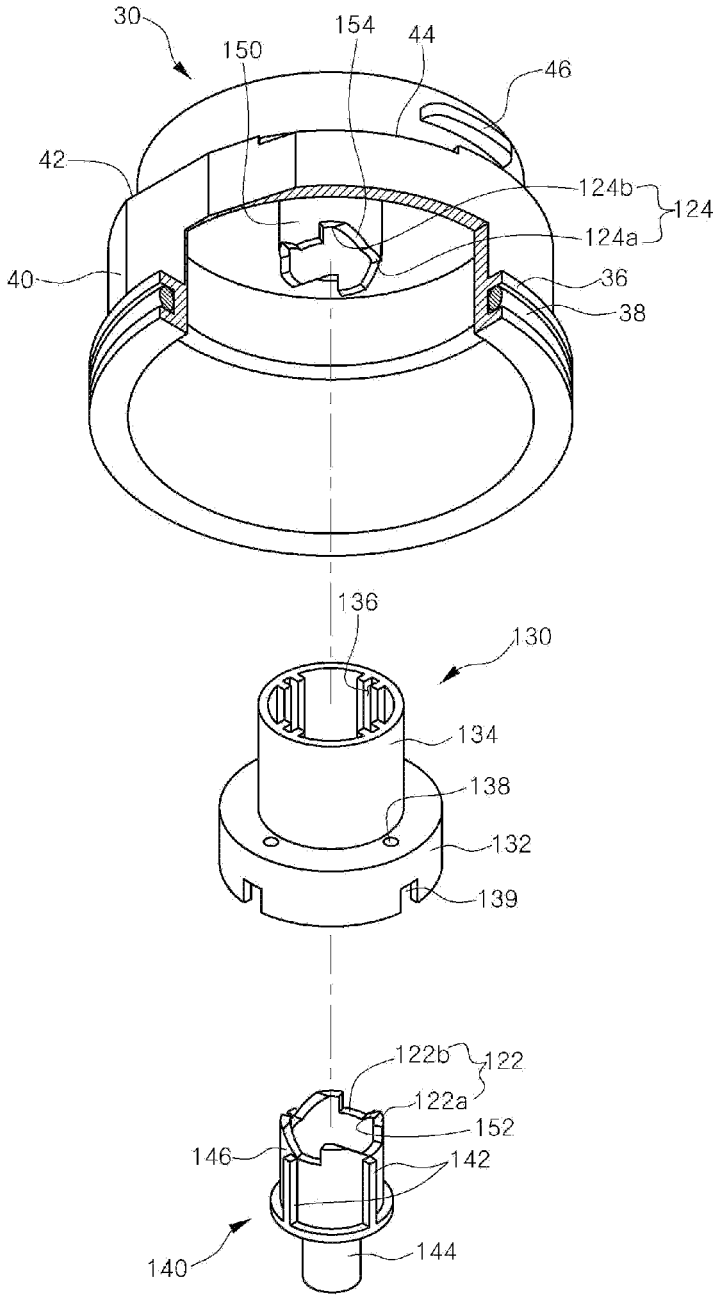
FIG. 8 is an exploded perspective view of a unit for pressuring the first valve plate in FIG. 1.

FIG. 1 is an exploded perspective view of a vacuum generating apparatus according to an exemplary embodiment of the present invention; FIG. 2 is a perspective view showing a partial incision surface in a state that a vacuum generating apparatus shown in FIG. 1 is assembled; FIG. 3 is a cross-sectional view of a vacuum generating apparatus taken along the line III-III in FIG. 2; FIG. 4 is a cross-sectional view of a vacuum generating apparatus taken along the line IV-IV in FIG. 2; FIG. 5 is a perspective view showing a bottom surface of a separation preventing plate shown in FIG. 1; FIG. 6 is a cross-sectional view of a guide groove formed at a cap member in FIG. 1; FIG. 7 is a top plan view showing an exemplary variation of a separation preventing plate in FIG. 1; and FIG. 8 is an exploded perspective view of a unit for pressuring the first valve plate in FIG. 1.

Referring to FIG. 1 to FIG. 8, a vacuum generating apparatus according to an exemplary embodiment of the present invention includes a receiving portion 12 formed at a cover 10 of a vacuum container creating a vacuum therein, a piston member 30 linearly movably disposed in the receiving portion 12, an elastic member 50 disposed in the receiving portion 12 and applying elastic force to the piston member 30, a first valve plate 60 closing or opening a first outlet 16 formed in the receiving portion 12, a second valve plate 70 closing or opening a second outlet 32 formed at the piston member 30 and a separation preventing plate 80 coupled to an upper portion of the receiving portion 12 and preventing separation of the piston member 30.

The receiving portion 12 is formed in a concave shape downwardly at an upper surface of the cover 10, and the first outlet 16 for exhausting air in the vacuum container is formed at a center of a bottom surface of the receiving portion 12. In addition, an accepting portion 18 having a larger diameter than the receiving portion 12 is formed above the receiving portion 12.

A first contacting portion 14 on which the first valve plate 60 is positioned in formed at the bottom surface of the receiving portion 12, and a plurality of protrusions 23 is formed at the first contacting portion 14.

A fixing portion 20 for fixing the separation preventing plate 80 to the receiving portion 12 is formed at the receiving portion 12 and the separation preventing plate 80.

The fixing portion 20, as shown in FIG. 3 and FIG. 5, includes a catching groove portion 22 formed in a concave shape at an upper end of an inner circumference of the receiving portion 12 and having a side connected to the accepting portion 18 and a catching protrusion portion 82 protruded to the outside from a lower portion of the separation preventing plate 80 so as to be fitted in the catching groove portion 22.

If the separation preventing plate 80 is positioned on the accepting portion 18, the catching protrusion portion 82 is positioned near an entrance of the catching groove portion 22. If the separation preventing plate 80 is rotated at this time, the catching protrusion portion 82 is fitted into the catching groove portion 22 and the separation preventing plate 80 is fixed to the receiving portion 12.

The piston member 30 has a cylindrical shape having an open lower end, and a second contacting portion 34 which is closely contacted to the second valve plate 70 is formed at an upper surface of the piston member 30. In addition, a ring portion 36 in a protruded shape is formed at an outer circumference of a lower end of the piston member 30, a sealing member 38 is mounted at the ring portion 36, and the sealing member 38 closely contacts with an inner surface of the receiving portion 12 so as to maintain air-tightness in the receiving portion 12.

At least one flat surface portion 40 is formed at an outer circumference of the piston member 30, and an opening into which the piston member 30 is inserted is formed at a center of the separation preventing plate 80. A rotation preventing protrusion 84 in a straight shape corresponding to the flat surface portion 40 is formed at an inner circumference of the opening. If the flat surface portion 40 and the rotation preventing protrusion 84 contact with each other, a position at which the flat surface portion 40 and the outer circumference of the piston member 30 are connected is caught by the rotation preventing protrusion 84 and the piston member 30 does not rotate when the piston member 30 moves upwardly or downwardly.

In addition, a catching stepped portion 42 having a smaller exterior diameter is formed at an upper portion of the piston member 30, and at least one catching step 44 connected to the flat surface portion 40 is formed at at least part of the catching stepped portion 42 along the outer circumference of the piston member 30.

If the piston member 30 is pushed, the flat surface portion 40 is separated from the rotation preventing protrusion 84. In addition, the catching stepped portion 42 is positioned substantially on the same line as the rotation preventing protrusion 84 and the catching step 44 is positioned below the rotation preventing protrusion 84. If the catching step 44 is positioned below the rotation preventing protrusion 84, the piston member 30 can rotate within a range of the catching step 44 and maintain a descent state.

A cap member 100 is fitted on an upper surface of the piston member 30. The cap member 100 is coupled to the upper surface of the piston member 30 so as to prevent separation of the second valve plate 70 disposed on the piston member 30. When a worker pushes the piston member 30, a hand of the worker contacts with the cap member 100.

As shown in FIG. 1, a catching groove portion 102 having a side connected to a bottom surface of the cap member 100 is formed at an inner circumference of the cap member 100. A catching protrusion portion 46 coupled to the catching groove portion 102 is formed at an exterior circumference of an upper portion of the piston member 30. If the cap member 100 is positioned on an upper surface of the piston member 30, the catching protrusion portion 46 is positioned near an entrance of the catching groove portion 102. If the cap member 100 is rotated, the catching protrusion portion 46 moves along the catching groove portion 102 and is fitted into the catching groove portion 102, as shown in FIG. 4. Therefore, the cap member 100 is fixed to the piston member 30.

In addition, a guide groove 104 is formed at an inner upper surface of the cap member 100. The guide groove 104 guides the air so as to exhaust the air exhausted through the second outlet 32 to the exterior.

The guide groove 104, as shown in FIG. 1, FIG. 3 and FIG. 6, is divaricated from a circular groove 106 disposed above the first contacting portion 34 and extends to an edge of the cap member 100.

The first valve plate 60 is formed to have the same shape as the second valve plate 70, and is formed as a circular plate having a center portion protruded upwardly in a convex shape. Position aligning protrusions 62 and 72 are formed respectively at centers of bottom surfaces of the first valve plate 60 and the second valve plate 70. The position aligning protrusions 62 and 72 are inserted in the first outlet 16 and the second outlet 32 and line up the first valve plate 60 and the second valve plate 70, respectively.

Herein, the first valve plate 60 and the second valve plate 70 are made of thin rubber material such that the first valve plate 60 and the second valve plate 70 closely contact with the first contacting portion 14 and the second contacting portion 34 and close and seal the first outlet 16 and the second outlet 32, respectively. Material of the first valve plate 60 and the second valve plate 70 may be any material that can closely contact with the first contacting portion 14 and the second contacting portion 34 and shut off flow of air.

A lower end of the elastic member 50 is supported by the first contacting portion 14 and an upper end of the elastic member 50 is supported by an interior surface of an upper end of the piston member 30 such that elastic force is applied in a direction where the piston member 30 moves far away from the first contacting portion 14. The elastic member 50 is a coil spring, a diameter of which becomes larger and larger in an upward direction. Instead of the coil spring, any member which can apply elastic force to the piston member can be used as the elastic member.

A month displaying portion 86 and a day displaying portion 88 that display a time of storing contents are formed at the separation preventing plate 80, as shown in FIG. 7. A month pointer 110 pointing the month displaying portion 88 and a day pointer 112 pointing the day displaying portion 88 are mounted at the cap member 100 so as to be movable along an exterior circumference of the cap member 100.

A unit for pressuring the first valve plate 120 is disposed in the piston member 30. The unit for pressuring the first valve plate 120 physically presses the first valve plate 60 so as to be closely contacted with the first outlet 16 if the piston member 30 is pushed and is then rotated to one direction.

The unit for pressuring the first valve plate 120 includes a supporting member 130 disposed on the first contacting portion 14 of the receiving portion 12, a pressing rod 140 disposed movably in an upward or downward direction in the supporting member 130 so as to press the first valve plate 60, an operating rod 150 protruded from a lower surface of the piston member 30 and contacting with the pressing rod 140, and cam portions 122 and 124 formed at end portions of the pressing rod 140 and the operating rod 150 and moving the pressing rod 140 downwardly if the piston member 30 is rotated by a predetermined range.

The supporting member 130 has a ring shape and includes an accepting portion 132 positioned on an edge of the first contacting portion 14 and a guide portion 134 formed on an upper surface of the accepting portion 132 and having a cylindrical shape, a diameter of which is smaller than that of the accepting portion 132. A guide groove 136 is formed at an inner circumference of the guide portion 134 along a length direction of the guide portion 134.

A plurality of air exhaust holes 138 for exhausting air is formed at an upper surface of the accepting portion 132 along a circumferential direction, and a rotation preventing groove 139 coupled with a plurality of protrusions 23 (referring to FIG. 1) formed with a predetermined distance at the edge of the first contacting portion 14 is formed at a lower portion of the accepting portion 132. The supporting member 130 cannot be rotated since the protrusion 23 is coupled to the rotation preventing groove 139. Four protrusions 23 and four rotation preventing grooves 139 are formed in the present exemplary embodiment. One among four protrusions 23 and one among four rotation preventing grooves 139 have different size from the others of four protrusions 23 and four rotation preventing grooves 139. If so, each point of the supporting member 130 can be always positioned at the same position when the supporting member 130 is positioned on the first contacting portion 14.

In addition, the pressing rod 140 includes a rod body 146 positioned in the guide portion 134 and a pushing portion 144 formed at a lower portion of the rod body 146, positioned in the accepting portion 132, and pushing the first valve plate 60.

A guide protrusion 142 that is inserted in the guide groove 136 is formed at an exterior circumference of the rod body 146. Since the guide protrusion 142 is inserted in the guide groove 136, the pressing rod 140 does not rotate and can move linearly along a length direction of the supporting member 130.

Four guide grooves 136 and four guide protrusions 142 are formed in the present exemplary embodiment. One among four guide grooves 136 and one among four guide protrusions 142 have different size from the others of four guide grooves 136 and four guide protrusions 142. If so, each point of protrusions and depressions of the cam portion 122 formed on an upper surface of the rod body 146 can be positioned at the same position when the pressing rod 140 and the supporting member 130 are coupled.

The cam portions 122 and 124 include first protrusions and depressions 122 formed on an upper surface of the pressing rod 140 and second protrusions and depressions 124 formed on a lower surface of the operating rod 150.

The first protrusions and depressions 122 include a plurality of first convex portions 122*a* protruded in a convex shape from the upper surface of the pressing rod 140 with circumferentially even distance, a plurality of first recess portions 122*b* formed between the plurality of first convex portions 122*a*, and first slanted surfaces 152 disposed between the first convex portions 122*a* and the first recess portions 122*b* and connecting the first convex portions 122*a* with the first recess portions 122*b*.

The second protrusions and depressions 124 are formed with the same shape as the first protrusions and depressions 122, and include second recess portions 124*b* facing the first convex portions 122*a*, second convex portions 124*a* facing the first recess portions 122*b*, and second slanted surfaces 154 disposed between the second convex portions 124*a* and the second recess portions 124*b* and connecting the second convex portions 124*a* with the second recess portions 124*b*.

In a state that the piston member 30 does not move downwardly and does not rotate, that is the flat surface portion 40 of the piston member 30 faces the rotation preventing protrusion 84 of the separation preventing plate 80, the second convex portion 124*a* of the operating rod 150 faces the first recess portion 122*b* of the pressing rod 140 and the second recess portion 124*b* of the operating rod 150 faces the first convex portion 122*a* of the pressing rod 140. Therefore, the operating rod 150 does not apply force to the pressing rod 140 during the piston member 30 is pumped.

If the piston member 30, on the contrary, moves downwardly and rotates, the second convex portion 124*a* of the operating rod 150 climbs up the first slanted surface 152 of the pressing rod 140 so as to press the first convex portion 122*a* of the pressing rod 140.

Operation of the vacuum generating apparatus according to the above-described exemplary embodiment will be described in detail.

Figure 9:
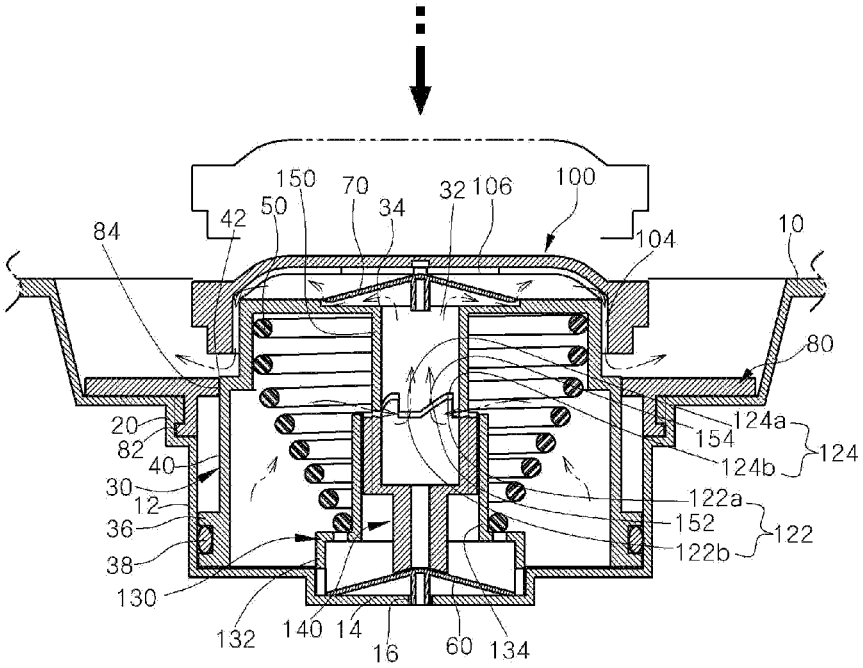
FIG. 9 to FIG. 11 are cross-sectional views showing operation of a vacuum generating apparatus according to an exemplary embodiment of the present invention.
Figure 10:
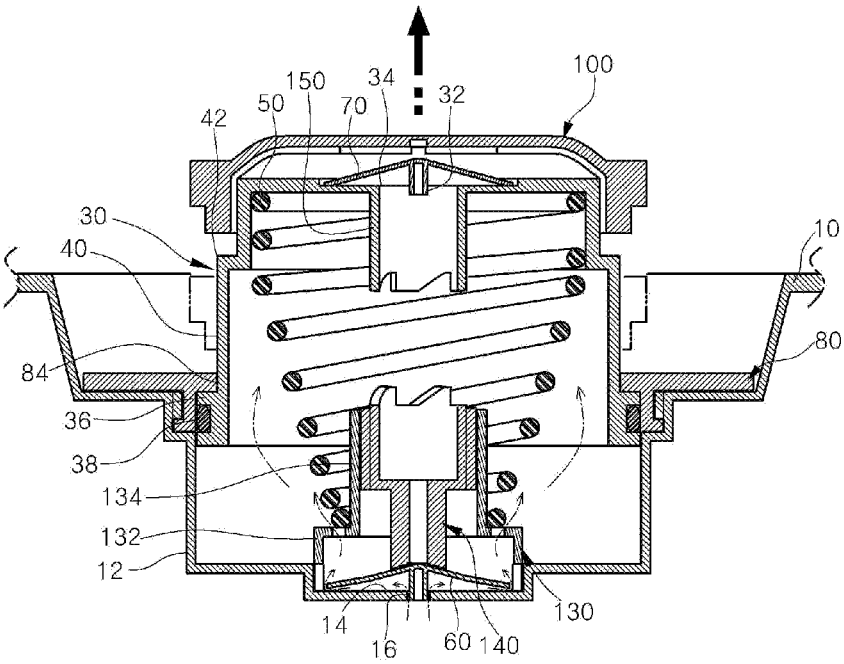
Figure 11:
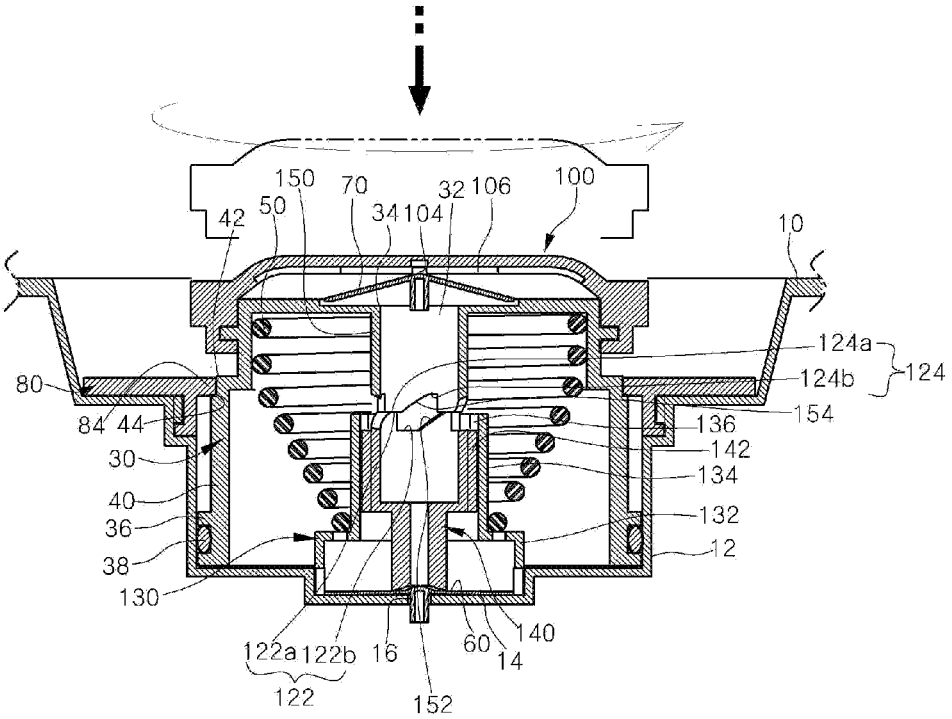

FIG. 9 to FIG. 11 are cross-sectional views showing operation of a vacuum generating apparatus according to an exemplary embodiment of the present invention.

If the cap member 100 is pushed downwardly, as shown in FIG. 9, the piston member 30 moves downwardly in the receiving portion 12. At this time, air in the receiving portion 12 is exhausted to the exterior through the second exhaust hole 32.

That is, if the piston member 30 is pushed, an area in the receiving portion 12 reduces and the air in the receiving portion 12 is pressurized. By the air pressure, the second valve plate 70 is separated from the second contacting portion 34 and the second exhaust hole 32 is open. If the second exhaust hole 32 is open, the air in the receiving portion 12 is exhausted between the piston member 30 and the cap member 100. The exhausted air is exhausted to the exterior through the guide groove 104.

If the piston member 30 is pushed, the cam portions 122 and 124 of the pressing rod 140 and the operating rod 150 are coupled with each other without applying force to each other. That is, the second convex portion 124*a* of the operating rod 150 is inserted in the first recess portion 122*b* of the pressing rod 140, and the first convex portion 122*a* of the pressing rod 140 is inserted in the second recess portion 124*b* of the operating rod 150.

If force pushing the piston member 30 is removed, as shown in FIG. 10, the piston member 30 moves upwardly by elastic force of the elastic member 50 and pressure in the receiving portion 12 becomes lower than pressure of a storing space 210 (refer to FIG. 12) of the vacuum container. Then, the first valve plate 70 is separated from the first contacting portion 14 and the first exhaust hole 16 is open. If the first exhaust hole 16 is open, the air in the storing space 210 of the vacuum container flows into the receiving portion 12 through the first exhaust hole 16.

If vacuum is sufficiently generated in the vacuum container by repeating above-mentioned processes, the piston member 30 is pushed and then rotated such that the catching step 44 of the piston member 30 is caught by the rotation preventing protrusion 84 of the separation preventing plate 80 as shown in FIG. 11. Therefore, the piston member 30 is maintained to be pushed.

If the piston member 30 is caught by the separation preventing plate 80 and becomes a descent state, the unit for pressuring the first valve plate presses the first valve plate 60 so as to closely contact with the first contacting portion 14. If doing so, the air is completely prevented from flowing into the vacuum container through the first exhaust hole 16.

Operation of the unit for pressuring the first valve plate will be described in detail. If the piston member 30 is rotated after being descended, the catching step 44 is caught by the rotation preventing protrusion 84 and the piston member 30 is maintained to be the descent state. If the piston member 30 is rotated, the second convex portion 124*a* of the operating rod 150 is separated from the first recess portion 122*b* of the pressing rod 140 and climbs up the first slanted surface 152. If the piston member 30 is completely rotated, the first convex portion 122*a* of the pressing rod 140 is pressed.

At this time, the pressing rod 140 is not rotated by the guide groove 136 and the guide protrusion 142 and moves downwardly along a length direction of the supporting member 130. The pushing portion 144 of the descended pressing rod 140 pushes the first valve plate 60 physically such that the first valve plate 60 is pressed on the first contacting portion 14. The pressed first valve plate 60 closes and seals the first outlet 16 completely such that the air cannot flow into the vacuum container.

The piston member 30 can be rotated until the catching stepped portion 42 is caught by the rotation preventing protrusion 64.

The vacuum container to which the above-mentioned vacuum generating apparatus according to the exemplary embodiment is applied will be described in detail.

Figure 12:
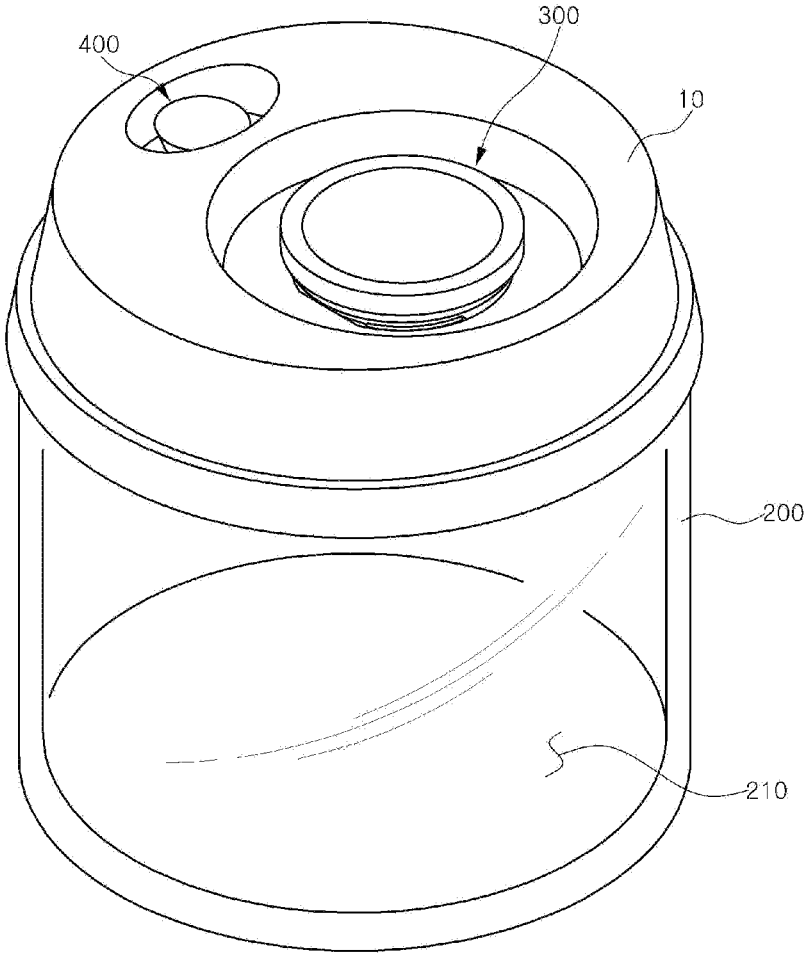
FIG. 12 is a perspective view of a vacuum container according to an exemplary embodiment of the present invention.
Figure 13:
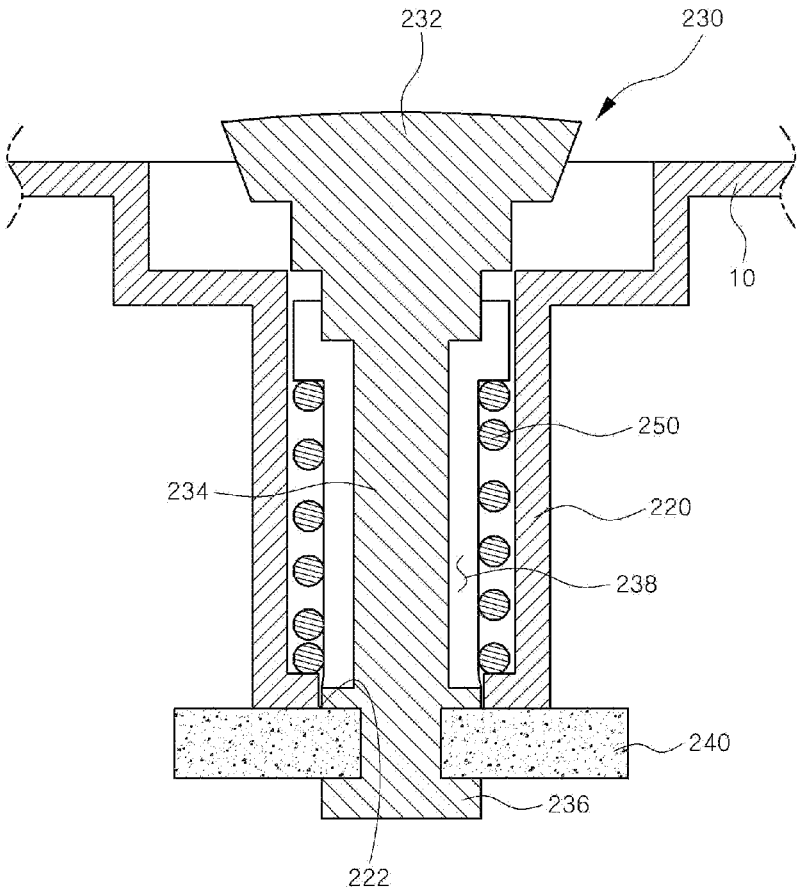
FIG. 13 is a cross-sectional view of a vacuum release apparatus shown in FIG. 12.
Figure 14:
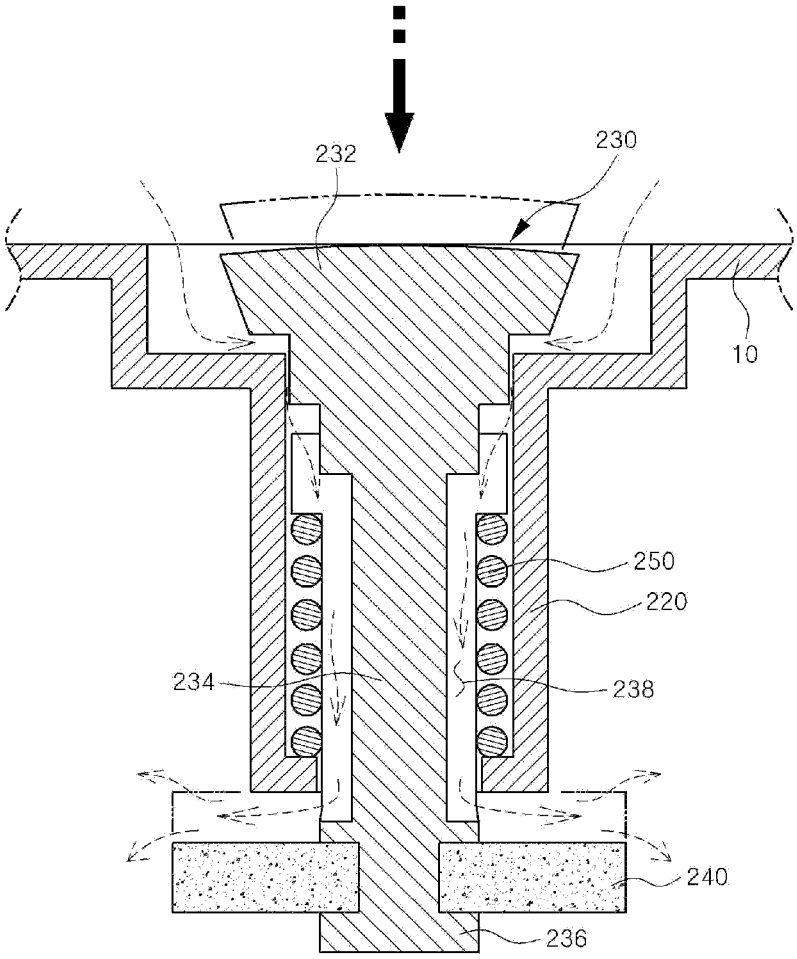
FIG. 14 is a cross-sectional view showing operation of a vacuum release apparatus shown in FIG. 12.

FIG. 12 is a perspective view of a vacuum container according to an exemplary embodiment of the present invention; FIG. 13 is a cross-sectional view of a vacuum release apparatus shown in FIG. 12; and FIG. 14 is a cross-sectional view showing operation of a vacuum release apparatus shown in FIG. 12.

The vacuum container according to an exemplary embodiment of the present invention includes a main body 200 having the storing space 210 in which contents is stored, the cover 10 sealingly covering the main body 200, and the vacuum generating apparatus 300 mounted at the cover 10 and generating vacuum in the storing space 210. The vacuum container further includes a vacuum release apparatus 400 mounted at the cover 10 and releases the vacuum of the storing space 210.

Structure and operation of the vacuum generating apparatus 300 are substantially the same as those of the above-mentioned vacuum generating apparatus according to the exemplary embodiment.

The vacuum release apparatus 400 includes a push rod 230 formed at a side portion of the cover 10, mounted in the receiving portion 220 having an air inflow hole 222, and having an end portion inserted in the air inflow hole 222, a sealing member 240 positioned in the storing space 210 and mounted at the end portion of the push rod 230 so as to open or close the air inflow hole 222, and an elastic member 150 mounted at a circumference of the push rod 230 and applying elastic force to the push rod 230 such that an upper surface of the push rod 230 is away from the receiving portion 220.

The push rod 230 is disposed in the receiving portion 220 and is movable upwardly and downwardly. If the push rod 230 is pressed, the push rod 230 moves downwardly and the sealing member 240 moves toward a bottom surface of the storing space 210. Therefore, the air inflow hole 222 is open.

The push rod 230 includes a pushing portion 232 disposed at an upper portion thereof, a rod portion 234 extending downwardly from the pushing portion 232, and a mounting portion 236 formed at an end portion of the rod portion 234 and penetrating through the air inflow hole 222 such that at least a portion of the mounting portion 236 is positioned in the storing space 210.

In addition, an air guide 238 is formed between the push rod 230 and an interior surface of the receiving portion 220. The air guide 238 is formed in a length direction of the push rod 230 and guides an exterior air to the storing space 210.

The sealing member 240 is positioned in the storing space 210 and fixed to the mounting portion 236. The sealing member 240 may be closely contact with or be apart from the bottom surface of the receiving portion 220. If the sealing member 240 closely contacts with the bottom surface of the receiving portion 220, the air inflow hole 222 is closed. In this case, the exterior air cannot flow into the storing space 210. On the contrary, the air in the storing space 210 cannot be exhausted to the exterior.

The elastic member 250 may be a coil spring. An upper portion of the elastic member 250 is supported by the push rod 230 and a lower portion of the elastic member 250 is supported by the bottom surface of the receiving portion 220 such that the elastic force is applied to the pushing portion 232 in a direction away from the bottom surface of the receiving portion 220. The sealing member 240 is maintained to be closely contacted to the bottom surface of the receiving portion 220 by the elastic force of the elastic member 250.

Operation of the vacuum release apparatus will be described in detail. The vacuum is generated in the storing space 220 by the vacuum generating apparatus 300. If the pushing portion 232 of the push rod 230 is pushed in order to release the vacuum, the push rod 230 moves downwardly and the elastic member 250 is compressed, as shown in FIG. 14.

If the sealing member 240 is separated from the bottom surface of the receiving portion 220, the air inflow hole 222 is fluidly communicated with the storing space 210. Then, the exterior air flows into the storing space 210 of the main body 200 through the air guide 238 and the air inflow hole 222 formed at the push rod 230. Therefore, the vacuum of the storing space is released. In addition, if the force applied to the pushing portion 232 is removed, the elastic force of the elastic member 250 is applied to the push rod 230 and the pushing portion 232 is far from the receiving portion 220. Therefore, the sealing member 240 closes and seals the air inflow hole 222.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A vacuum generating apparatus, comprising:

a piston member linearly movably disposed in a receiving portion which is formed at a vacuum chamber and has a first outlet, and provided with a second outlet, an elastic member disposed inside of the piston member, a first valve plate disposed in the receiving portion and adapted to open or close the first outlet, a second valve plate disposed at the piston member and adapted to open or close the second outlet, a separation preventing plate mounted in the receiving portion such that the piston member penetrates through an inner hole of the separation preventing plate to prevent separation of the piston member, the piston member ascending and descending relative to the separation preventing plate to create a vacuum, wherein rotating the piston member at a descended position fixes the piston member relative to the separation preventing plate to prevent ascending of the piston member, and a unit for pressuring the first valve plate comprising:

a supporting member disposed on the receiving portion and having a vertically hollow inside;

a pressing rod positioned in the supporting member and adapted to contact and press the first valve plate to close the first outlet in response to descending and rotating of the piston member causing fixation of the piston member to the separation preventing plate; and an operating rod connected to the piston member to move with the piston member relative to the pressing rod and adapted to contact and press the pressing rod in response to the descending and rotating of the piston member.

2. The vacuum generating apparatus of claim 1, wherein the supporting member comprises:

an accepting portion positioned on a bottom surface of the receiving portion and having at least one air exhaust hole at a surface thereof, and a guide portion connected to the accepting portion, having a smaller circumference than the accepting portion, and having at least one guide groove formed at an interior surface thereof, wherein at least one guide protrusion inserted in the at least one guide groove is formed at an exterior circumference of the pressing rod.

3. The vacuum generating apparatus of claim 2, wherein a rotation preventing groove is formed at the accepting portion, and a protrusion inserted in the rotation preventing groove is formed on the bottom surface of the receiving portion.

4. The vacuum generating apparatus of claim 1, wherein the unit for pressuring the first valve plate further comprises cam portions formed at confronting surfaces of the pressing rod and the operating rod.

5. The vacuum generating apparatus of claim 4, wherein the cam portions comprise first protrusions and depressions formed at the pressing rod and second protrusions and depressions formed at the operating rod.

6. The vacuum generating apparatus of claim 5, wherein the first protrusions and depressions comprise a plurality of first convex portions disposed with even distances, a plurality of first recess portions formed between the first convex portions and first slanted surfaces connecting the first convex portions and the first recess portions, the second protrusions and depressions comprise a plurality of second convex portions disposed with even distances, a plurality of second recess portions formed between the second convex portions and second slanted surfaces connecting the second convex portions and the second recess portions, and the second convex portion presses the first convex portion in response to the descending of the piston member.

7. The vacuum generating apparatus of claim 1, wherein at least one flat surface portion is formed at a circumference of the piston member, a catching step is formed at a side of the piston member, and a ring portion is formed at the other side of the piston member, a rotation preventing protrusion confronting the flat surface portion in a raised state of the piston member is formed inside of the separation preventing plate such that the ring portion is caught by the rotation preventing protrusion and the piston member cannot further be raised in the raised state, and the piston member is not caught by the rotation preventing protrusion and is rotatable in response to the descending of the piston member such that the catching step is caught by the rotation preventing protrusion so as to maintain a descent state of the piston member when the piston member rotates in the descent state.

8. The vacuum generating apparatus of claim 1, wherein the first outlet comprises a first position aligning protrusion and the second outlet comprises a second position aligning protrusion, the first position aligning protrusion and the second position aligning protrusion are adapted to align positions of the first valve plate and the second valve plate, and the first position aligning protrusion is formed at a bottom surface of the first valve plate and the second position aligning protrusion is formed at a bottom surface of the second valve plate.

9. A vacuum container comprising a cover at which the vacuum generating apparatus of claim 1 is mounted and a main body coupled to the cover so as to form a storing space.

10. A vacuum container comprising:

a main body having a storing space, a cover which can be coupled with the main body and has a first receiving portion, wherein a first outlet communicating the storing space with the exterior is formed at the first receiving portion, a piston member movably disposed in the first receiving portion and provided with a second outlet formed therein, an elastic member disposed in the piston member, a first valve plate disposed in the first receiving portion and adapted to open or close the first outlet, a second valve plate disposed at the piston member and adapted to open or close the second outlet, a separation preventing plate mounted in the first receiving portion such that the piston member penetrates through an inner hole of the separation preventing plate to prevent and preventing separation of the piston member, the piston member ascending and descending relative to the separation preventing plate to create a vacuum, wherein rotating the piston member at a descended position fixes the piston member relative to the separation preventing plate to prevent ascending of the piston member, and a unit for pressuring the first valve plate comprising:

a supporting member disposed on the receiving portion and having an inside opened vertically;

a pressing rod positioned in the supporting member and adapted to press the first valve plate to close the first outlet in response to descending and rotating of the piston member causing fixation of the piston member to the separation preventing plate;

an operating rod connected to the piston member to move with the piston member relative to the pressing rod and adapted to contact and press the pressing rod in response to the descending and rotating of the piston member; and a cam portion formed at confronting surfaces of the pressing rod and the operating rod.

11. The vacuum container of claim 10, wherein a highest cam portion of the operating rod is adapted to press a highest cam portion of the pressing rod in response to the descending of the piston member.

12. The vacuum container of claim 10, further comprising a vacuum release apparatus mounted at a second receiving portion formed at the cover and releasing the vacuum of the storing space, wherein air existing at the outside of the storing space is supplied into the storing space in response to pushing of the vacuum release apparatus in a direction toward the storing space.

13. The vacuum container of claim 12, wherein an air inflow hole is formed at a bottom surface of the second receiving portion, wherein the vacuum release apparatus comprises:

a push rod disposed in the second receiving portion and being vertically movable, a sealing member connected to the push rod, positioned at the storing space, and sealing the air inflow hole, and an elastic member mounted at a circumference of the push rod and applying elastic force to the push rod away from the storing space.

* * * * *